US006572753B2

(12) United States Patent
Chalyt et al.

(10) Patent No.: US 6,572,753 B2
(45) Date of Patent: Jun. 3, 2003

(54) METHOD FOR ANALYSIS OF THREE ORGANIC ADDITIVES IN AN ACID COPPER PLATING BATH

(75) Inventors: Gene Chalyt, Washington Township, NJ (US); Peter Bratin, Flushing, NY (US); Michael Pavlov, Fairlawn, NJ (US); Alex Kogan, Carlstadt, NJ (US); Michael James Perpich, Hackensack, NJ (US)

(73) Assignee: ECI Technology, Inc., East Rutherford, NJ (US)

( * ) Notice: Subject to any disclaimer, the term of this patent is extended or adjusted under 35 U.S.C. 154(b) by 92 days.

(21) Appl. No.: 09/968,202

(22) Filed: Oct. 1, 2001

(65) Prior Publication Data

US 2003/0062266 A1 Apr. 3, 2003

(51) Int. Cl.[7] ..... G01N 27/26; C25D 21/12

(52) U.S. Cl. ..... 205/81; 205/101; 205/296; 205/775; 205/780.5; 205/786.5; 205/787

(58) Field of Search ..... 205/81, 101, 296, 205/775, 780.5, 782, 786.5, 787

(56) References Cited

U.S. PATENT DOCUMENTS 4,479,852 A * 10/1984 Bindra et al. ..... 204/1 T
5,223,118 A * 6/1993 Sonnenberg et al. ..... 205/81
6,280,602 B1 * 8/2001 Robertson ..... 205/775
6,508,924 B1 * 1/2003 Gomez et al. ..... 205/81

* cited by examiner

*Primary Examiner*—Roy King
*Assistant Examiner*—William T. Leader
(74) *Attorney, Agent, or Firm*—D. Morgan Tench

(57) ABSTRACT

Acid copper electroplating baths used to form ultra-fine circuitry features on semiconductor chips contain suppressor, anti-suppressor and leveler additives that must be closely controlled in order to obtain acceptable copper deposits. Cyclic voltammetric stripping (CVS) methods are available to measure the concentrations of the suppressor and anti-suppressor based on the effects of these additives on the copper electrodeposition rate. The present invention is a method that also uses measurements of the copper electrodeposition rate to determine the concentration of the leveler additive. The other two additives are included in the measurement solution at concentrations determined to provide the optimum compromise between minimal interference, high sensitivity and good reproducibility for the leveler analysis. In this case, measurement precision is greatly improved compared to that provided by inclusion of the interfering additives in the measurement solution at their concentrations in the bath sample at the time of the analysis, which would be the standard analytical procedure.

27 Claims, 6 Drawing Sheets

METHOD FOR ANALYSIS OF THREE ORGANIC ADDITIVES IN AN ACID COPPER PLATING BATH

BACKGROUND OF THE INVENTION

1. Field of the Invention

This invention is concerned with analysis of organic additives in plating baths as a means of providing control over the deposit properties.

2. Description of the Related Art

Electroplating baths typically contain organic additives whose concentrations must be closely controlled in the low parts per million range in order to attain the desired deposit properties and morphology. One of the key functions of such additives is to level or brighten the deposit by suppressing the electrodeposition rate at peaks in the substrate surface. Leveling/brightening of the deposit results from faster metal deposition within recessed areas where the additive, which is present at low concentration, is less effectively replenished by diffusion/bath agitation as it is consumed in the electrodeposition process. The most sensitive methods available for detecting leveling and brightening additives in plating baths involve electrochemical measurement of the metal electrodeposition rate under controlled hydrodynamic conditions for which the additive concentration in the vicinity of the electrode surface is well-defined.

Cyclic voltammetric stripping (CVS) analysis [D. Tench and C. Ogden, J. Electrochem. Soc. 125, 194 (1978)] is the most widely used bath additive control method and involves cycling the potential of an inert electrode (e.g., Pt) in the plating bath between fixed potential limits so that metal is alternately plated on and stripped from the electrode surface. Such voltage cycling is designed to establish a steady state for the electrode surface so that reproducible results are obtained. Cyclic pulse voltammetric stripping (CPVS), also called cyclic step voltammetric stripping (CSVS), is a variation of the CVS method that employs discrete changes in voltage during the analysis to condition the electrode so as to improve the measurement precision [D. Tench and J. White, J. Electrochem. Soc. 132, 831 (1985)]. A rotating disk electrode configuration is typically employed for both CVS and CPVS analysis to provide controlled hydrodynamic conditions. Accumulation of organic films or other contaminants on the electrode surface can be avoided by periodically voltage cycling the electrode in the plating solution without organic additives and, if necessary, polishing the electrode using a fine abrasive. The metal deposition rate can be determined from the current or charge passed during metal electrodeposition but it is usually advantageous to measure the charge associated with anodic stripping of the metal from the electrode. The CVS method was first applied to control copper pyrophosphate baths (U.S. Pat. No. 4,132,605 to Tench and Ogden) but has since been adapted for control of a variety of other plating systems, including the acid copper sulfate baths that are widely used by the electronics industry [e.g., R. Haak, C. Ogden and D. Tench, Plating Surf. Fin. 68(4), 52 (1981) and Plating Surf. Fin. 69(3), 62 (1982)].

Acid copper sulfate electroplating baths require a minimum of two types of organic additives to provide deposits with satisfactory properties and good leveling characteristics. The suppressor additive is typically a polymeric organic species, e.g., high molecular weight polyethylene or polypropylene glycol, which adsorbs strongly on the copper cathode surface to form a film that sharply increases the overvoltage for copper deposition. This prevents uncontrolled copper plating that would result in powdery or nodular deposits. An anti-suppressor additive is required to counter the suppressive effect of the suppressor and provide the mass-transport-limited rate differential needed for leveling. Plating bath vendors typically provide additive solutions that may contain additives of more than one type, as well as other organic and inorganic addition agents. The suppressor additive may be comprised of more than one chemical species and generally involves a range of molecular weights.

Both the suppressor and the anti-suppressor additive concentrations in acid copper sulfate baths can be determined by CVS analysis methods based on the effects that these additives exert on the copper electrodeposition rate. For the suppressor analysis, the CVS rate parameter, usually the copper stripping peak area at a given electrode rotation rate ($A_r$), is first measured in a supporting electrolyte having approximately the same composition as the plating bath to be analyzed but without organic addition agents. Additions of known volume ratios of the plating bath to the supporting electrolyte (or to a background electrolyte having known concentrations of other additives) produce decreases in the CVS rate parameter that reflect the concentration of the suppressor additive. This "standard addition" suppressor analysis is not significantly affected by the presence of the anti-suppressor, which exerts a relatively weak effect on the copper deposition rate at the plating bath dilution levels involved. For the anti-suppressor analysis, a sufficient amount of the suppressor additive, which may be comprised of a plurality of components or species, is added to the supporting electrolyte to produce a background electrolyte exhibiting substantially the maximum suppression of the copper deposition rate (minimum CVS rate parameter). Additions of known volume ratios of the plating bath to this fully-suppressed background electrolyte produce increases in the CVS rate parameter that can be related to the concentration of the anti-suppressor additive. The exact procedures for CVS analysis of acid copper sulfate baths can vary.

Analysis for the suppressor additive (also called the "polymer", "carrier", or "wetter", depending on the bath supplier) typically involves generation of a calibration curve by measuring the CVS rate parameter $A_r$ in a supporting or background electrolyte (without organic additives or with known concentrations of interfering additives), termed $A_r(0)$, and after each standard addition of the suppressor additive. For the calibration curve, $A_r$ may be plotted against the suppressor concentration directly, or normalized as $A_r/A_r(0)$ to minimize measurement errors associated with changes in the electrode surface, background bath composition, and temperature. For the suppressor analysis itself, $A_r$ is first measured in the supporting electrolyte and then after each standard addition of a known volume ratio of the plating bath sample to be analyzed. The suppressor concentration may be determined from the $A_r$ or $A_r/A_r(0)$ value for the measurement solution (supporting electrolyte plus a known volume of plating bath sample) by interpolation with respect to the appropriate calibration curve ("response curve analysis"). Alternatively, the suppressor concentration may be determined by the "dilution titration" method from the volume ratio of plating bath sample (added to the supporting electrolyte) required to decrease $A_r$ or $A_r/A_r(0)$ to a given value, which may be a specific numerical value or a minimum value (substantially maximum suppression) [W. O. Freitag, C. Ogden, D. Tench and J. White, Plating Surf. Fin. 70(10), 55 (1983)]. Note that the effect of the anti-suppressor on the suppressor analysis is typically small but can be taken into account by including in the background electrolyte the amount of anti-suppressor measured or estimated to be present in the plating bath being analyzed.

The concentration of the anti-suppressor additive (also called the "brightener", "accelerator" or simply the "additive", depending on the bath supplier) is typically determined by the linear approximation technique (LAT) or modified linear approximation technique (MLAT) described by R. Gluzman [Proc. $70^{th}$ Am. Electroplaters Soc. Tech. Conf., Sur/Fin, Indianapolis, Ind. (June 1983)]. The CVS rate parameter, $A_r$, is first measured in background electrolyte containing no anti-suppressor but with a sufficient amount of suppressor species added to substantially saturate suppression of the copper deposition rate. A known volume ratio of the plating bath sample to be analyzed is then added to this fully-suppressed background electrolyte and $A_r$ is again measured. The $A_r$ measurement is then repeated in this mixed solution after each addition (typically two) of known amounts of the anti-suppressor additive only. The concentration of the anti-suppressor in the plating bath sample is calculated assuming that $A_r$ varies linearly with anti-suppressor concentration, which is verified if the change in $A_r$ produced by standard additions of the same amount of anti-suppressor are equivalent.

Acid copper sulfate baths have functioned well for plating the relatively large surface pads, through-holes and vias found on printed wiring boards (PWB's) and are currently being adapted for plating fine trenches and vias in dielectric material on semiconductor chips. The electronics industry is transitioning from aluminum to copper as the basic metallization for semiconductor integrated circuits (IC's) in order to increase device switching speed and enhance electromigration resistance. The leading technology for fabricating copper IC chips is the "Damascene" process (see, e.g., P. C. Andricacos, Electrochem. Soc. Interface, Spring 1999, p.32; U.S. Pat. No. 4,789,648 to Chow et al.; U.S. Pat. No. 5,209,817 to Ahmad et al.), which depends on copper electroplating to provide complete filling of the fine features involved. The organic additives in the bath must be closely controlled since they provide the copper deposition rate differential required for bottom-up filling.

As the feature size for the Damascene process has shrunk below 0.2 $\mu$m, it has become necessary to utilize a third organic additive in the acid copper bath in order to avoid overplating the trenches and vias. Note that excess copper on Damascene plated wafers is typically removed by chemical mechanical polishing (CMP) but the copper layer must be uniform for the CMP process to be effective. The third additive is called the "leveler" (or "booster", depending on the bath supplier) and is typically an organic compound containing nitrogen or oxygen that also tends to decrease the copper plating rate. In order to attain good bottom up filling and avoid overplating of ultra-fine chip features, the concentrations of all three additives must be accurately analyzed and controlled.

The concentrations of the suppressor and anti-suppressor in acid copper plating baths can be analyzed with good precision in the presence of the leveler additive by the standard CVS methods. At the additive concentrations typically employed, the effect of the suppressor in reducing the copper deposition rate is usually much stronger than that of the leveler so that the concentration of the suppressor can be determined by the usual CVS response curve or dilution titration analysis. Interference from the leveler can be minimized by utilizing a background electrolyte for the suppressor analysis that contains approximately the same leveler concentration as in the plating bath being analyzed, estimated from the bath makeup composition and previous analyses. Likewise, the anti-suppressor concentration can be determined by the LAT or MLAT analysis procedure and the approximate bath concentration of leveler can be added to the fully-suppressed background electrolyte to minimize leveler interference. With some modifications, for example, to account for relatively high leveler activity or to reduce anti-suppressor interference on the suppressor analysis, these CVS procedures provide reliable measures of the suppressor and anti-suppressor additives used in currently-available acid copper electroplating baths. However, a method is needed for measuring the leveler concentration in the presence of interference from both the suppressor and anti-suppressor.

Since the suppressor and anti-suppressor concentrations can be independently determined, the obvious approach based on traditional chemical analysis practice would be to add these interfering additives, at the concentrations measured for the plating bath, to the background electrolyte used for the leveler analysis. In this matrix matching approach, the leveler concentration would be determined from the change in the CVS rate parameter produced by addition of a known volume ratio of the plating bath sample to the background electrolyte. A calibration curve would be generated by measuring the CVS rate parameter as a function of the concentration of leveler added to the same background electrolyte. However, since the suppressor and anti-suppressor concentrations in the plating bath vary with time, calibration curves would be needed for all combinations of suppressor and anti-suppressor concentrations that occur in the plating bath. An average calibration curve could be used but at a significant sacrifice in measurement accuracy. Furthermore, the sensitivity of the analysis to the leveler concentration is poor for some combinations of suppressor and anti-suppressor concentrations encountered during production operation.

There is a critical need for a method of determining the concentration of the leveler additive in acid copper baths with high precision under all bath operating conditions. It is also desirable to avoid the necessity of generating and utilizing a plurality of calibration curves, which is required for CVS analysis based on traditional analytical approaches.

SUMMARY OF THE INVENTION

This invention is a voltammetric method for measuring the concentration of a leveler additive in an acid copper sulfate electroplating bath also containing suppressor and anti-suppressor additives. The method is based on measuring the change in copper deposition rate produced by the leveler additive species. Interference from the suppressor and anti-suppressor additives, which also affect the copper deposition rate, is minimized by adjusting their concentrations in a measurement solution (comprised of sample of the plating bath and a background electrolyte), and in the background electrolyte used for calibration, to the optimum levels for analysis of the leveler. The copper deposition rate in this adjusted measurement solution provides an exceptionally sensitive and reproducible measure of the concentration of the leveler additive since the measurement is always made at the optimum concentrations of the interfering suppressor and anti-suppressor additives, which may be substantially higher or lower than their respective concentrations in the plating bath sample. Further improvement is provided by optimizing the voltammetric parameters used to measure the copper deposition rate so as to provide maximum sensitivity to the leveler and minimum interference from the suppressor and anti-suppressor. The optimum suppressor and anti-suppressor concentrations and optimum set of measurement parameters need to be determined for each additive system and, in some cases, for each additive batch. The analysis of the present invention also requires only one calibration curve for a given additive system. The concentrations of the suppressor and anti-suppressor additives in the plating bath sample are usually measured at the time of the leveler analysis but may sometimes be estimated with sufficient accuracy based on previous analyses.

The method of the present invention contrasts sharply with the obvious approach based on conventional analytical practice of utilizing a matrix matched background electrolyte containing the two interfering additives at their concentrations in the plating bath at the time of the analysis. In this conventional case, the change in copper deposition rate in the background electrolyte produced by addition of a known volume ratio of the plating bath sample also provides a measure of the leveler concentration. However, since the suppressor and anti-suppressor concentrations in the plating bath vary with time, calibration curves are needed for all combinations of suppressor and anti-suppressor concentrations that occur in the plating bath during operation. Furthermore, the sensitivity of the analysis to the leveler concentration and the extent of interference from the suppressor and anti-suppressor depend on the relative concentrations of these interfering additives. For some additive systems, additions of the leveler to copper plating solutions containing the normal levels of suppressor and anti-suppressor produces practically no change in the copper deposition rate so that the conventional matrix matching approach cannot be used.

The copper deposition rate for the method of the present invention is preferably determined by cyclic voltammetric stripping (CVS) or cyclic pulse voltammetric stripping (CPVS). The latter is also called cyclic step voltammetric stripping (CSVS). As used in this document, the term "cyclic voltammetric stripping" or "CVS" implicitly includes the CPVS method, which is a variation of the CVS method. Likewise, the term "CVS rate parameter" includes the analogous CPVS voltammetric rate parameters. In these methods, the potential of an inert electrode, e.g., Pt, is cycled in a plating solution, at a constant rate or in steps, so that copper is alternately plated on the electrode surface and anodically stripped back into the solution. Potential cycling improves the reproducibility of the results by establishing steady-state conditions at the electrode surface. A rotating disk electrode configuration is typically used to provide the well-defined hydrodynamic conditions that are also needed for reproducible results. The copper deposition rate is typically measured via the copper stripping peak area with electrode rotation ($A_r$) but might also be determined from the stripping peak height, or from the electrode impedance, current or charge corresponding to a given cathodic potential or potential range (with or without electrode rotation). Improved reproducibility and accuracy may be provided by using a normalized CVS rate parameter, for example, the ratio $A_r/A_r(0)$ of the stripping peak area for the measurement solution to that for a supporting electrolyte without additives or to that for a background electrolyte with known concentrations of interfering additives.

Preferably, the suppressor and anti-suppressor concentrations are also determined from their effects on the copper deposition rate. In this case, synergy among the various additives is automatically taken into account and an effective or active concentration is obtained, which is more indicative of the performance of the additive in the plating bath than a strictly analytical concentration. The suppressor, which generally exerts a much stronger effect than the other additives at low concentrations, may be determined by CVS response curve or dilution titration analysis. In this case, dilution of the bath sample during standard additions to a background electrolyte renders the suppressor effect dominant. The anti-suppressor may be determined via the CVS linear approximation technique (LAT) or modified linear approximation technique (MLAT) analysis from its effect in increasing the copper deposition rate in a background electrolyte containing sufficient suppressor for maximum copper deposition suppression. Modifications in these analysis procedures may be needed for some additive systems, for example, to account for relatively high leveler activity or to reduce anti-suppressor interference on the suppressor analysis. Generally, the CVS measurement parameters are optimized for each type of analysis (leveler, suppressor and anti-suppressor) and depend on the particular additive system. Such optimization improves measurement sensitivity and reproducibility and helps minimize interference from the other additives. Within the scope of the present invention, the suppressor and anti-suppressor additives may also be analyzed by other methods, e.g., spectrophotometry, electrochemical ac impedance measurements, electrochemical impedance spectroscopy, or high performance liquid chromatography (HPLC).

Another aspect of the claimed invention provides improved precision for the leveler voltammetric analysis by taking into account variations in the inorganic content of the plating bath. Since chloride exerts a strong effect on the functioning of organic additives used in acid copper baths, its concentration should, if necessary, be adjusted to be within the appropriate range (typically, 25 to 100 ppm) in the plating bath sample being analyzed, and in the background and supporting electrolytes used for the analysis. Variations in the chloride, sulfuric acid and copper ion concentrations within the ranges recommended by the bath supplier usually have a negligible effect on the voltammetric analysis results and typically need to be adjusted in measurement solutions only for analyses requiring very high accuracy. If the particular leveler species used exerts a relatively weak effect on the copper deposition rate and/or the leveler concentration in the plating bath is relatively low, however, variations in the copper content of the plating bath can have a significant effect on the results of the leveler analysis. In this case, the accuracy and precision of the leveler analysis of the present invention may be improved by correcting the measurement solution voltammetric rate parameter for the difference in copper ion concentration resulting from addition of the plating bath to the supporting electrolyte.

Further features and advantages of the invention will be apparent to those skilled in the art from the following detailed description, taken together with the accompanying drawings.

DETAILED DESCRIPTION OF THE INVENTION

Figure 1:
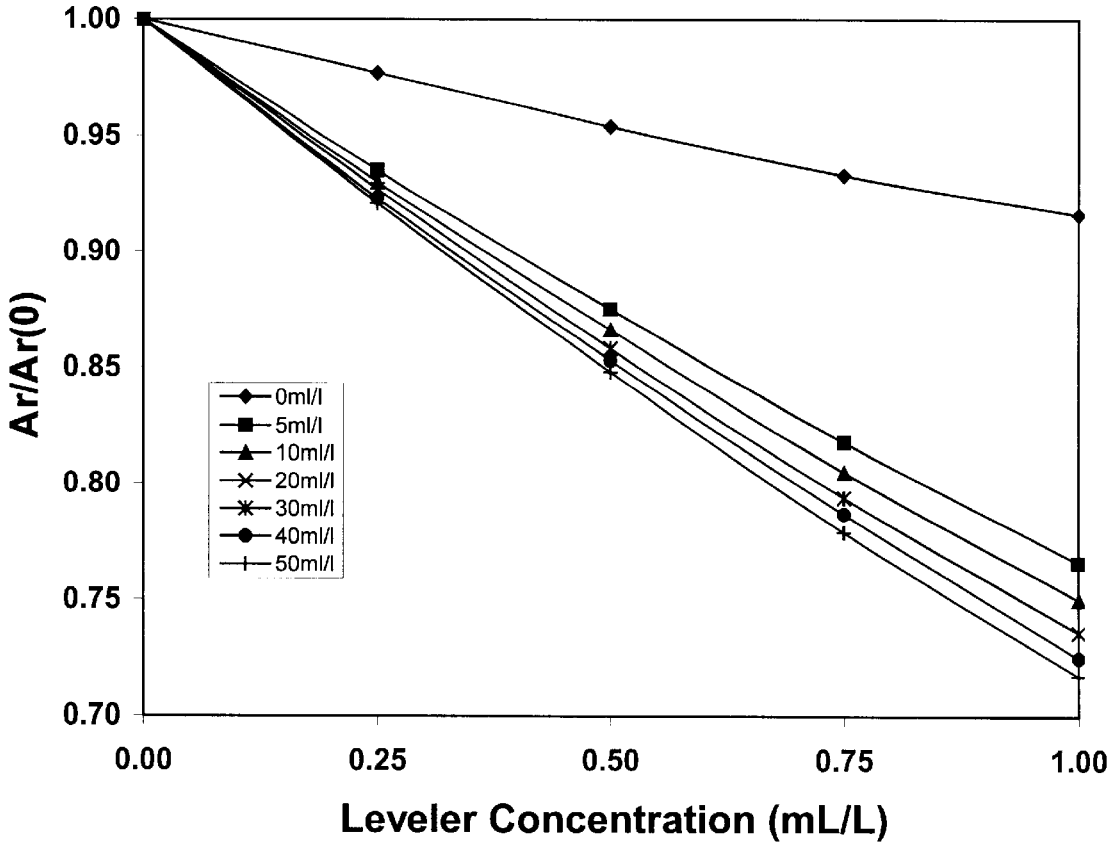
FIG. 1 shows plots of the normalized CVS rate parameter $A_r/A_r(0)$ as a function of the leveler additive concentration for various suppressor additive concentrations in a commercial acid copper sulfate plating bath containing 40 mL/L of anti-suppressor additive.

Acid copper sulfate electroplating baths used to plate ultra-fine circuitry features on semiconductor chips require at least three organic additives that must be closely controlled in order to obtain deposits with satisfactory properties. The "suppressor" additive is typically a polymeric organic species, e.g., high molecular weight polyethylene or polypropylene glycol, that adsorbs strongly on the copper cathode surface and decreases the copper deposition rate at a given voltage. This prevents uncontrolled copper plating that would result in powdery or nodular deposits. The "anti-suppressor" additive is generally a sulfur-containing organic species and counters the suppressive effect of the suppressor, increasing the copper deposition rate under some conditions. The anti-suppressor is present at relatively low concentrations and provides the diffusion-limited copper deposition rate differential needed for deposit leveling, and bottom-up filling of semiconductor chip features. The "leveler" additive is generally an organic compound containing nitrogen or oxygen that also tends to decrease the copper plating rate so as to prevent overplating of ultra-fine semiconductor chip features.

This suppressor/anti-suppressor/leveler terminology is used throughout this document. Different terms are used for some additives by the various bath suppliers, making comparisons somewhat difficult. In some cases, the same term may be used by different suppliers for different additive types. In addition, additives are generally supplied in the form of solutions that may contain more than one additive species or combination of additives, and the chemical nature and concentrations of the additive species are typically not specified and may be changed from time to time by the supplier without notice. Regardless of terminology used by a given bath supplier, the present invention pertains to analysis of the leveler additive, which, depending on the supplier, may be any one of two additives that tend to decrease the deposition rate of copper from an acid copper plating bath. The other of these two additives is measured by a conventional method, preferably CVS response curve or dilution titration analysis. On a per volume basis, the leveler additive analyzed by the method of the present invention typically exerts a weaker decelerating effect on the copper electrodeposition rate than the suppressor additive, but this need not be the case.

Unless otherwise noted, "supporting electrolyte" means a solution having substantially the same or similar inorganic content as the plating bath being analyzed but without organic additives. The term "background electrolyte" refers to supporting electrolyte containing the organic additives needed for the particular analysis under discussion. The term "optimum background electrolyte" refers to a background electrolyte containing the concentrations of the suppressor and anti-suppressor additives that are optimum for the leveler analysis. The "measurement solution" is comprised of a background electrolyte and a sample of the plating bath to be analyzed, and may include additional additives. If specified, the inorganic content of the background electrolyte may also be modified compared to that of the supporting electrolyte.

In this document, the term "standard addition" generally means addition of a known volume of an additive solution or plating bath sample to a known volume of a supporting electrolyte or background electrolyte. This term would also encompass addition of a known weight of a solid additive species to a known volume of a supporting electrolyte or background electrolyte. When a plating bath sample is added to another solution, the volumes of both are assumed to be known. In addition, calibration data are typically handled as calibration curves or plots but such data may be tabulated and used directly, especially by a computer, and the terms "curve" or "plot" used in this document include tabulated data.

The inorganic content of acid copper electroplating baths varies greatly depending on the type of bath. High-acid baths typically contain 40–100 g/L copper sulfate, 140–240 g/L sulfuric acid and 25–100 ppm chloride ion. Low-acid baths typically contain 125–200 g/L copper sulfate, 1–40 g/L sulfuric acid and 25–100 ppm chloride ion. The analysis of the present invention could also be applied to acid copper baths employing similar additive systems but based on different anions, e.g., fluoroborate, sulfamate or alkylsulfonate, and might be applied to plating baths involving other electrodepositable metals, e.g., tin, tin-lead, zinc and nickel.

According to the present invention, the leveler additive concentration in an acid copper electroplating bath is determined by measuring the rate of copper electrodeposition in a measurement solution comprised of a background electrolyte and a sample of the electroplating bath. The concentrations of suppressor and anti-suppressor in the measurement solution (and the measurement parameters) are adjusted to the optimum values providing the best compromise between high sensitivity to the leveler concentration and low sensitivity to the concentrations of the interfering additives. Typically, the copper electrodeposition rate is first measured in the supporting electrolyte, then in the optimum background electrolyte comprised of the supporting electrolyte with the optimum concentrations of suppressor and anti-suppressor added, and finally in a measurement solution comprised of the background electrolyte plus a known volume of the plating bath sample adjusted to the optimum concentrations of suppressor and anti-suppressor. Obviously, such adjustment can be made by adding suppressor and anti-suppressor to the plating bath sample or to the measurement solution. Improved reproducibility may be provided by utilizing a normalized copper deposition rate parameter, which is the ratio of the rate parameter for the measurement solution to that for the supporting electrolyte or the optimum background electrolyte. Typically, the supporting electrolyte is used for normalization when the optimum suppressor and anti-suppressor concentrations are less than their maximum concentrations in the plating bath, and the optimum background electrolyte is used when at least one of the optimum concentrations is more than the respective maximum value in the plating bath.

The optimum suppressor and anti-suppressor concentrations for the leveler analysis depend on the particular additive system (bath supplier) and may be higher or lower than the concentrations in the plating bath itself. When the optimum concentrations are higher, appropriate additional amounts of suppressor and anti-suppressor are added to the plating bath sample before addition to the measurement solution, or to the measurement solution after addition of the bath sample. When the optimum concentrations are lower than the respective concentrations in the plating bath, the plating bath sample is over diluted by addition to the measurement solution and appropriate amounts of suppressor and anti-suppressor are added to provide the optimum concentrations. In both cases, dilution of the leveler by addition to the measurement solution must be taken into account in determining its concentration from the change in copper deposition rate.

The optimum suppressor and anti-suppressor concentrations for the leveler analysis may be determined by measuring the copper electrodeposition rate as a function of leveler concentration in a background electrolyte containing various concentrations of the suppressor and anti-suppressor additives. High sensitivity to the leveler additive is indicated by a steep slope for a plot of copper electrodeposition rate vs leveler concentration at constant suppressor and anti-suppressor concentrations. Such plots for various suppressor and anti-suppressor concentrations are very similar when sensitivity to these interfering additives is low. One such plot providing an optimum compromise between high sensitivity to the leveler and low sensitivity to the suppressor and anti-suppressor is selected for use as the calibration curve for analysis of the leveler concentration in electroplating bath samples. Measurement convenience and the reproducibility of the results are also considerations in this selection. A separate calibration is needed for each additive system, even if some of the components are chemically the same. In some cases, a separate calibration may be needed for each additive batch because of batch to batch variations in the activities of the additive species. A statistical analysis approach, e.g., Design Of Experiments (DOE), could be used to determine the optimum suppressor and anti-suppressor concentrations with fewer experiments.

The copper electrodeposition rate is preferably measured via a voltammetric rate parameter determined by the cyclic voltammetric stripping (CVS) method, including the CPVS variation of this method. In the CVS method, the potential of an inert working electrode, typically platinum, is cycled at a constant rate between fixed voltage limits to alternatively deposit and strip copper at the electrode surface. A variety of inert metals may be used as the working electrode material, including platinum, iridium, osmium, rhenium, gold, palladium, rhodium, ruthenium, tungsten, and alloys thereof. Other metals may be included as alloying agents. Improved measurement sensitivity and reproducibility are provided by using a disk electrode rotating at a constant rate to control solution mass transport. A typical rotating disk electrode is comprised of a platinum metal disk (4 mm diameter), with an electrical contact wire on the backside, embedded flush with one end of a fluorocarbon polymer rod (12 mm diameter) by hot pressing. Precise control over the working electrode potential is provided via an electronic potentiostat in conjunction with a commercial reference electrode, e.g., silver-silver chloride (SSCE), mercury-mercury sulfate, or saturated calomel electrode (SCE). A double junction may be used to extend the life of the reference electrode by inhibiting intrusion of plating bath species. The counter electrode is typically copper but an inert metal could also be employed. A plurality of potential cycles is typically used to establish a steady-state for the electrode surface so as to provide reproducible results. In the CPVS (CSVS) method, voltage pulses or steps are used to provide a more reproducible electrode surface but the copper electrodeposition rate parameters are typically the same as for the CVS method.

Possible CVS copper deposition rate parameters include the copper stripping peak area, the copper stripping peak height, the current at a specific cathodic potential, the integrated current over a cathodic potential range, and the average current over a cathodic potential range. All of these rate parameters provide a relative measure of the copper electrodeposition rate that can readily be used for comparisons only when the measurement conditions are the same. When one deposition rate is compared to another in this document, the measurement parameters and conditions are implicitly assumed to be substantially the same. Although the precision and reproducibility of the analysis would be degraded, current measurements reflecting the copper deposition rate could also be made at a stationary electrode and without potential cycling. The deposition rate in a plating bath may also be measured by other methods, including those based on measurements of the ac impedance of the cathode, for example.

The preferred CVS copper deposition rate parameter is the integrated copper stripping peak area for the rotating electrode ($A_r$), which provides the most reproducible results. Reproducibility can be further improved by utilizing the ratio of $A_r$ for the solution being analyzed to $A_r(0)$ for the solution without additives or containing only the interfering additives.

Best results are provided by optimizing the CVS or CPVS measurement parameters for the particular additive system. The key CVS measurement parameters and their typical ranges include the electrode rotation rate (100–10,000 rpm), potential scan rate (10–1000 mV/s), negative potential limit (−0.05 to −0.5 V vs SSCE) and positive potential limit (1.4 to 1.8 V vs SSCE). Additional CPVS measurement parameters include the potentials and hold times for the pulses or steps used. Measurements should be made at constant solution temperature (typically 3° to 4° C. above room temperature for acid copper baths). Optimization of the CVS measurement parameters typically involve variations in the negative potential limit and/or the potential scan rate, which determine the amount of copper deposited on the electrode and thus the sensitivity of the rate parameter to additive effects. For example, a more negative potential limit or slower scan rate may be needed for deposition of sufficient copper when the suppressor effect is relatively strong. Another key optimization parameter is the electrode rotation rate, which determines the rate at which additive species are replenished at the electrode surface as they are consumed during copper electrodeposition. Typically, the rotation rate is increased for detection of an additive species present at relatively low concentration.

If the particular leveler species used exerts a relatively weak effect on the copper deposition rate and/or the leveler concentration in the plating bath is relatively low, it may be desirable to take variations in the copper ion concentration in the plating bath into account for the leveler analysis of the present invention. One approach would be to adjust the copper content of the background electrolyte, for each analysis, to match that of the plating bath being analyzed. However, such matrix matching would be time consuming and require use of different calibration curves for different copper ion concentrations. A better approach is to numerically correct the copper deposition rate parameter of the measurement solution for the change in copper concentration produced by addition of the plating bath sample. In this case, the stripping peak area ($A_r$) for the measurement solution, for example, is multiplied by the fraction, raised to the $n^{th}$ power, defined by the copper ion concentration of the supporting electrolyte divided by the copper ion concentration of the measurement solution resulting from addition of the plating bath sample. The value of n for a given additive system is determined empirically.

Within the scope of the present invention, the suppressor and anti-suppressor concentrations can be determined by any method but are preferably determined by methods based on CVS analysis, which are widely used. The suppressor, which generally exerts a much stronger effect on the copper electrodeposition rate compared to the other additives, is preferably determined by CVS response curve or dilution titration analysis. In this case, $A_r(0)$ is measured for the background electrolyte (containing either no additives or the anti-suppressor and/or leveler at the concentrations estimated to be in the plating bath sample), and $A_r$ is measured after each addition of a known volume ratio of plating bath to a background electrolyte. A calibration curve for this analysis is generated by measuring $A_r$ as a function of the concentration of suppressor added to the background electrolyte. The anti-suppressor is preferably determined by the MLAT analysis, which involves measurements of $A_r$ in a background electrolyte containing sufficient suppressor to provide practically the maximum decrease in copper electrodeposition rate. The background electrolyte may also contain the leveler additive at the concentration estimated to be in the plating bath. For the MLAT analysis, $A_r(0)$ is measured for the background electrolyte initially, and $A_r$ is measured after addition of a standard volume of plating bath sample and after at least one standard addition of anti-suppressor additive. The concentration of the anti-suppressor is calculated by assuming a linear $A_r$ response for anti-suppressor additions to the background electrolyte. For the LAT anti-suppressor analysis, the procedure is similar except that the $A_r(0)$ value is stored and used for subsequent analyses rather than being measured for each analysis. For both the suppressor and anti-suppressor analyses, the normalized copper deposition rate parameter $A_r/A_r(0)$ may be used to improve reproducibility. Other methods that might be used to measure the suppressor and/or anti-suppressor concentrations include spectrophotometry, electrochemical ac impedance measurements, electrochemical impedance spectroscopy, and high performance liquid chromatography (HPLC).

For some additive systems at some suppressor and anti-suppressor concentrations, the CVS rate parameter exhibits good sensitivity to the leveler concentration and interference from the suppressor and anti-suppressor is relatively small. In such cases, the suppressor and anti-suppressor concentrations need not be known with high precision and can simply be estimated based on known additive addition rates, prior analyses and expected changes with time under the bath operation conditions. Thus, it is not always necessary to measure the suppressor and anti-suppressor concentrations for each leveler analysis.

Description of a Preferred Embodiment

In a preferred embodiment of the present invention, the leveler, suppressor and anti-suppressor concentrations in acid copper electroplating baths are all determined from their effects on the CVS (or CPVS) copper stripping peak area ($A_r$), typically measured at a temperature 3°–4 ° C. higher than room temperature. Commercial equipment for making such measurements is available (ECI Technology, East Rutherford, N.J.). The measurement parameters are typically adjusted to provide high sensitivity for the measured additive and low interference from the other additives. Optimum accuracy is provided by utilizing the ratio of $A_r$ (for the calibration or measurement solution) to $A_r(0)$ for the background electrolyte. Use of this $A_r/A_r(0)$ ratio (normalized CVS rate parameter) for the copper electrodeposition rate measurement minimizes errors associated with variations in the background electrolyte composition and changes in the electrode surface or solution temperature. For best results, the background electrolyte and measurement solutions should contain chloride at a concentration within the range needed for proper bath functioning (25–100 ppm) and the other inorganic bath components should be maintained within the ranges recommended by the bath supplier.

Figure 2:
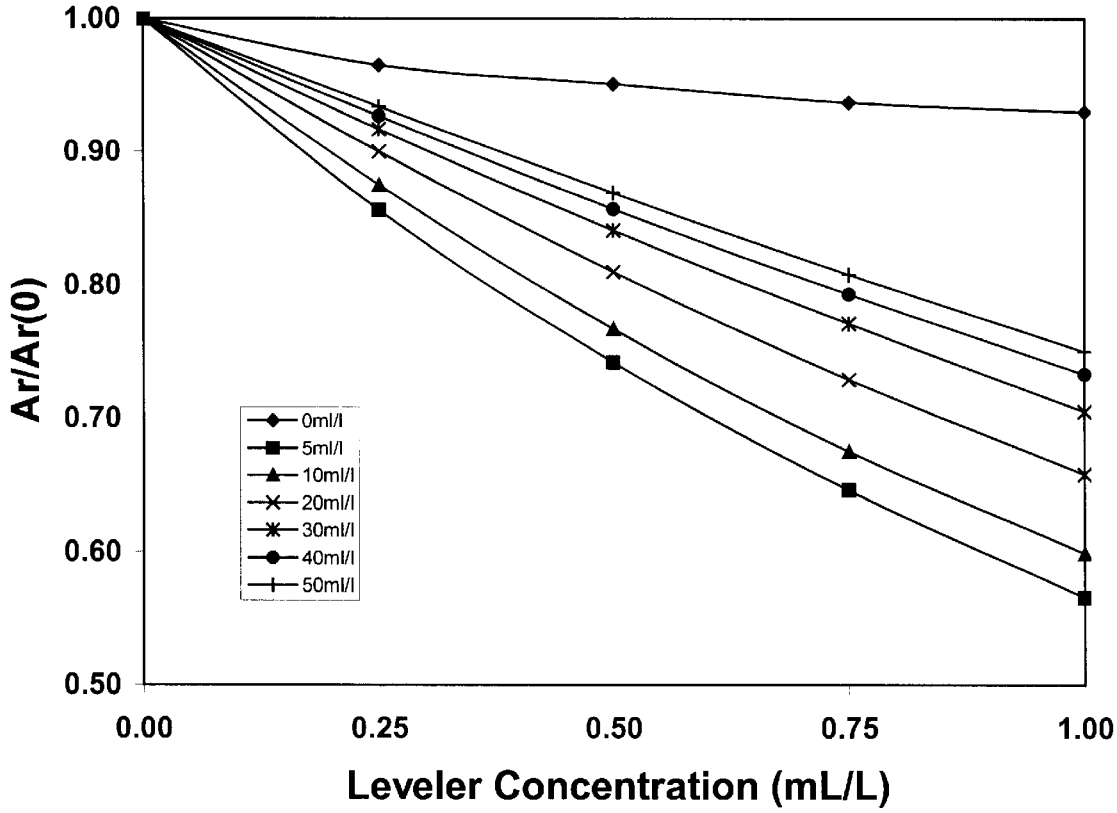
FIG. 2 shows plots of the normalized CVS rate parameter $A_r/A_r(0)$ as a function of the leveler additive concentration for various anti-suppressor additive concentrations in a commercial acid copper sulfate plating bath (same one as for FIG. 1) containing 40 mL/L of suppressor additive.
Figure 3:
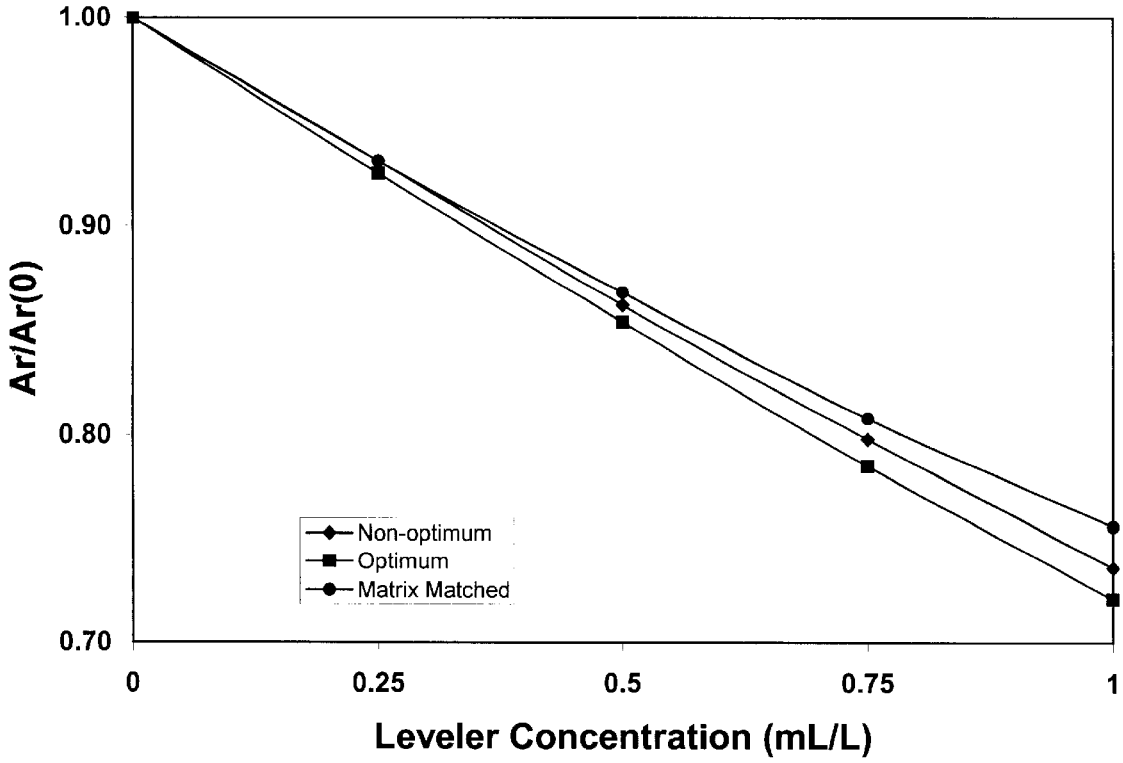
FIG. 3 shows calibration curves of the normalized CVS rate parameter $A_r/A_r(0)$ as a function of the leveler additive concentration in a commercial acid copper sulfate plating bath (same one as for FIGS. 1 and 2) having optimum, non-optimum and matrix-matched suppressor and anti-suppressor additive concentrations.

The concentrations of the suppressor and anti-suppressor providing optimum results for the leveler analysis are first determined from measurements of $A_r/A_r(0)$ as a function of leveler concentration in background electrolyte containing various concentrations of the suppressor and anti-suppressor additives. FIGS. 1, 2 and 3 give representative data of this type for a commercial acid copper sulfate plating bath (CUBATH® ViaForm®, Enthone-OMI, West Haven, Conn.). For the CVS measurements, the potential scan limits were −0.225 V and 1.575 V vs SSCE, the potential scan rate was 100 mV/s, and the electrode was rotated at 2500 rpm. FIG. 1 shows plots of $A_r/A_r(0)$ vs the leveler concentration for the bath with 40 mL/L of anti-suppressor additive and various concentrations of suppressor additive. High sensitivity to the leveler (high slope) and minimal interference (plots nearly the same) are evident for suppressor concentrations in the 10–50 mL/L range. FIG. 2 shows plots of $A_r/A_r(0)$ vs the leveler concentration for the bath with 40 mL/L of suppressor additive and various concentrations of anti-suppressor additive. In this case, high sensitivity to the leveler and minimal interference are evident for anti-suppressor concentrations in the 20–50 mL/L range.

FIG. 3 shows calibration curves for the leveler analysis at optimum, non-optimum and matrix-matched concentrations of suppressor and anti-suppressor additives. Respective suppressor and anti-suppressor concentrations were 40 mL/L and 40 mL/L for the optimum curve, 50 mL/L and 50 mL/L for the non-optimum curve, and 8 mL/L and 2 mL/L for the matrix-matched curve. The optimum curve has the steepest slope and also provides the most reproducible analysis results. The improved reproducibility provided by the optimum suppressor and anti-suppressor concentrations is evident from the relative standard deviations for analyses based on the three calibration curves, which were 3% for the optimum concentrations, 7% for the non-optimum concentrations and 14% for the matrix-matched concentrations.

Figure 4:
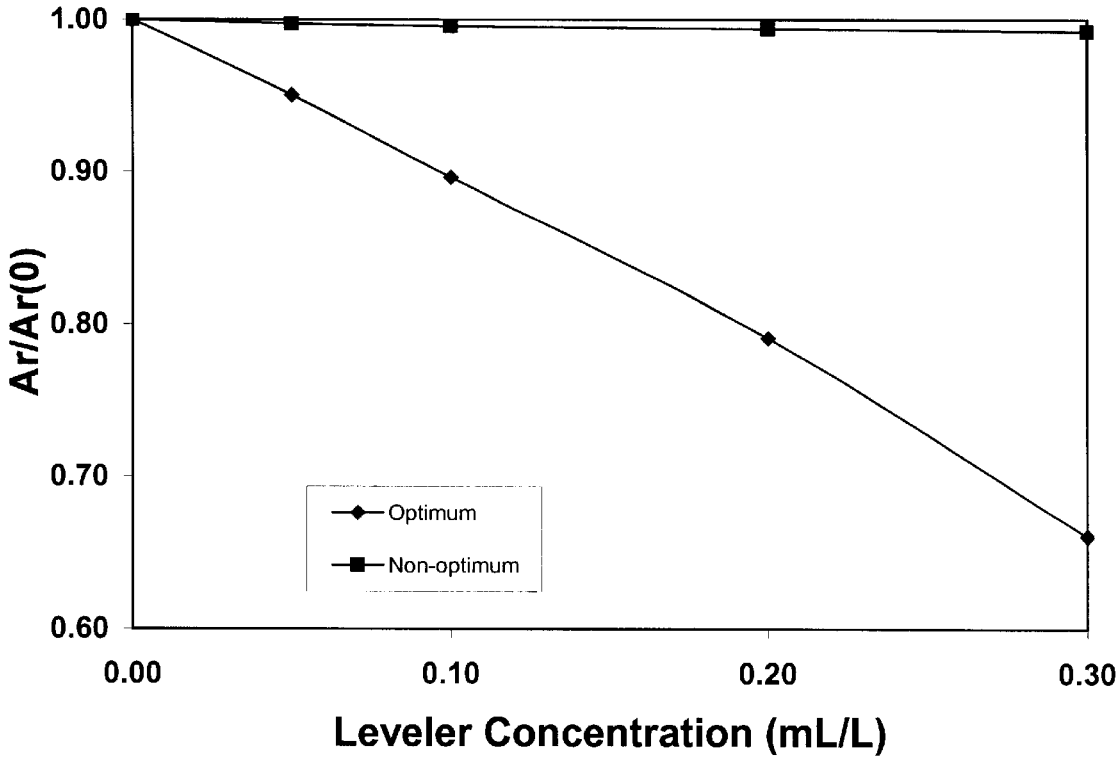
FIG. 4 shows calibration curves of the normalized CVS rate parameter $A_r/A_r(0)$ as a function of the leveler additive concentration in a non-commercial proprietary acid copper sulfate plating bath having optimum and non-optimum suppressor and anti-suppressor additive concentrations.

FIG. 4 shows calibration curves of the normalized CVS rate parameter $A_r/A_r(0)$ as a function of the leveler additive concentration in a non-commercial proprietary acid copper sulfate plating bath having optimum and non-optimum suppressor and anti-suppressor additive concentrations. This bath is used by one company for in-house Damascene copper plating of semiconductor chips. For the CVS measurements, the potential scan limits were −0.225 V and 1.525V vs SSCE, the potential scan rate was 100 mV/s, and the electrode was rotated at 500 rpm. The optimum suppressor and anti-suppressor concentrations were 0.1 mL/L and 0.6 mL/L, respectively. The non-optimum suppressor and anti-suppressor concentrations (12 mL/L and 2 mL/L, respectively) were the normal concentrations of these additives for this type of plating bath. Clearly, the conventional matrix matching approach cannot be used at all in this case since the non-optimum calibration curve shows practically no sensitivity to the leveler concentration.

Prior to the leveler analysis, the concentrations of suppressor and anti-suppressor in the plating bath sample are determined, preferably by analyses based on CVS measurements utilizing the $A_r/A_r(0)$ ratio. Preferred methods are the dilution titration (DT) for the suppressor and the modified linear approximation technique (MLAT) for the anti-suppressor. These analyses may not be necessary for a given leveler analysis if the suppressor and anti-suppressor concentrations can be estimated with sufficient accuracy based on the bath additive makeup composition, additive replenishment rates, prior additive analyses, and known additive consumption rates.

For the leveler analysis, the concentration of the suppressor and anti-suppressor in the background electrolyte and in the plating bath are adjusted to be the optimum values for the leveler analysis, corresponding to those for the selected calibration curve. The $A_r$ value is measured for the optimum background electrolyte before and after addition of a known volume of plating bath sample. Adjustments for the plating bath sample may be made by adding suppressor and anti-suppressor to the plating bath sample or to the measurement solution after addition of the plating bath sample. Since the plating bath sample is diluted by addition to the measurement solution, the suppressor and anti-suppressor concentrations used for the leveler analysis can be less than the corresponding concentrations in the plating bath (typically by a factor of 20–50).

If the particular leveler species used exerts a relatively weak effect on the copper deposition rate and/or the leveler concentration in the plating bath is relatively low, the $A_r$ value for the measurement solution should be corrected for any appreciable change in copper concentration produced by addition of the plating bath sample. In this case, the measured $A_r$ value is multiplied by $[(Cu^{2+}$ concentration in supporting electrolyte)/($Cu^{2+}$ concentration in the measurement solution)$]^n$, where n is determined empirically for a given additive system.

Figure 5:
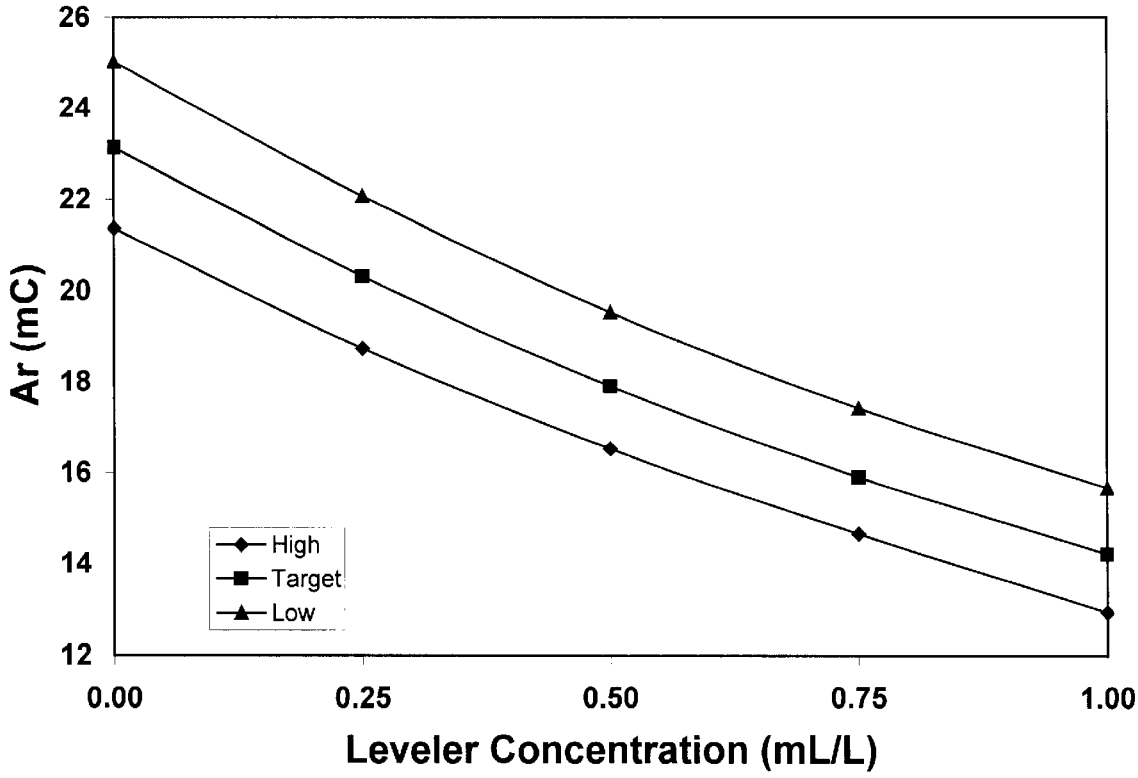
FIG. 5 shows the CVS rate parameter $A_r$ as a function of the leveler additive concentration in an acid copper plating bath with various concentrations of inorganic constituents. The low, target and high concentrations were: 35, 40 and 45 g/L copper ion; 8, 10 and 12 g/L sulfuric acid; and 30, 50 and 65 ppm chloride ion, respectively.
Figure 6:
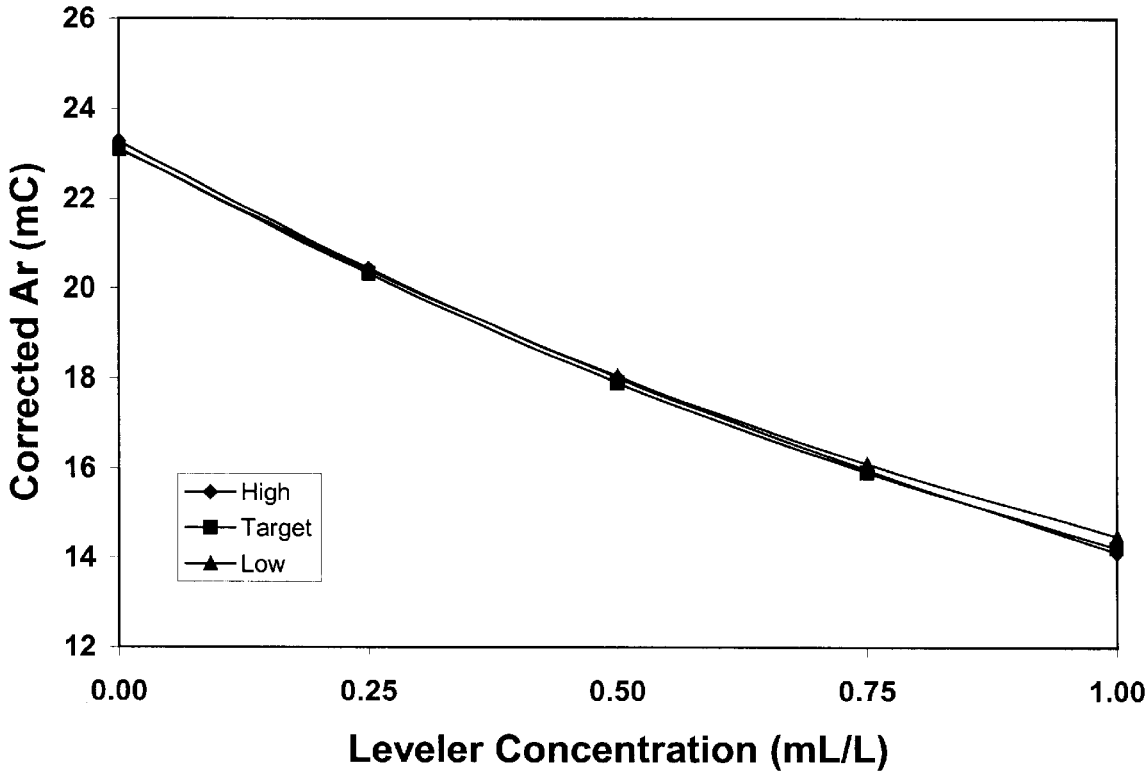
FIG. 6 shows the same curves as for FIG. 4 after correction of $A_r$ for variations in copper concentration in the plating bath.

FIGS. 4 and 5 show the effect of variations in the inorganic content of an acid copper plating bath (CUBATH® ViaForm®, Enthone-OMI, West Haven, Conn.) on calibration plots of $A_r$ as a function of the concentration of leveler before and after correction of $A_r$ for variations in copper ion concentration (n=0.675). For the CVS measurements, the potential scan limits were −0.225V and 1.575 V vs SSCE, the potential scan rate was 50 mV/s, and the electrode was rotated at 2500 rpm. The low, target and high concentrations were: 35, 40 and 45 g/L copper ion; 8, 10 and 12 g/L sulfuric acid; and 30, 50 and 65 ppm chloride ion, respectively. Correction of $A_r$ for copper ion concentration differences practically eliminated variations in the calibration plots. Note that the variations in sulfuric acid and chloride concentrations had no significant effect.

The preferred procedure for the leveler analysis of the present invention depends on whether the optimum suppressor and anti-suppressor concentrations for the additive system involved are higher or lower than the maximum concentrations of these additives in the plating bath. Examples of the former include the CUBATH® ViaForm® (Enthone-OMI, West Haven, Conn.) and Ultrafil® (Shipley Ronal, Marlborough, Mass.) systems. Optimum suppressor and anti-suppressor concentrations for the leveler analysis are lower than the operating concentrations for one non-commercial proprietary bath. For the procedures given below, "electrode conditioning" involves potential cycling until the $A_r$ values for successive cycles are the same within a specified error limit (typically 0.5%). Additions and measurements always involve the solution resulting from the preceding step. Standard additions involve known volume ratios of additive solutions or the plating bath sample. The "solution mixing" step involves allowing time for agitation provided by the rotating disk electrode to provide a homogeneous solution composition.

Preferred procedure for determining optimum suppressor and anti-suppressor concentrations for leveler analysis:

1. Electrode conditioning in supporting electrolyte (no additives)
2. Standard additions of suppressor and anti-suppressor
3. Solution mixing
4. Measure $A_r(0)$
5. Standard addition of leveler
6. Measure $A_r$
7. Repeat Steps 5–6 for series of leveler standard additions
8. Repeat Steps 1–7 for series of leveler standard additions at various suppressor and anti-suppressor concentrations
9. Plot or tabulate $A_r/A_r(0)$ vs leveler concentration for various suppressor and anti-suppressor concentrations
10. Identify optimum suppressor and anti-suppressor concentrations for which leveler sensitivity is high and interference is low.

Preferred calibration procedure when the optimum suppressor or anti-suppressor concentration is greater than its maximum concentration in the plating bath:

1. Electrode conditioning in supporting electrolyte (no additives)
2. Standard additions of suppressor and anti-suppressor to provide optimum concentrations
3. Solution mixing
4. Measure $A_r(0)$
5. Standard addition of leveler
6. Solution mixing
7. Measure $A_r$ for known leveler concentration
8. Repeat Steps 5–8 for various leveler concentrations
9. Plot or tabulate $A_r/A_r(0)$ vs leveler concentration for optimum suppressor and anti-suppressor concentrations.

Preferred plating bath analysis procedure when the optimum suppressor or anti-suppressor concentration is greater than its maximum concentration in the plating bath:

1. Electrode conditioning in supporting electrolyte (no additives)
2. Standard additions of suppressor and anti-suppressor to provide optimum concentrations
3. Solution mixing
4. Measure $A_r(0)$
5. Standard addition of plating bath sample
6. Standard addition of suppressor and anti-suppressor to provide optimum concentrations
7. Solution mixing 8. Measure $A_r$
9. Compare $A_r/A_r(0)$ from Steps 4–8 with the calibration plot or tabulated data to determine leveler concentration in the plating bath sample.

Preferred calibration procedure when the optimum suppressor and anti-suppressor concentrations are less than their maximum concentrations in the plating bath:

1. Electrode conditioning in supporting electrolyte (no additives)
2. Measure $A_r(0)$
3. Standard additions of suppressor and anti-suppressor to provide optimum concentrations
4. Solution mixing
5. Standard addition of leveler
6. Solution mixing
7. Measure $A_r$ for known leveler concentration
8. Repeat Steps 5–7 for various leveler concentrations
9. Plot or tabulate $A_r/A_r(0)$ vs leveler concentration for optimum suppressor and anti-suppressor concentrations.

Preferred plating bath analysis procedure when the optimum suppressor and anti-suppressor concentrations are less than their maximum concentrations in the plating bath:

1. Electrode conditioning in supporting electrolyte (no additives)
2. Measure $A_r(0)$
3. Standard addition of plating bath sample
4. Standard addition of suppressor and anti-suppressor to provide optimum concentrations
5. Solution mixing
6. Measure $A_r$
7. Compare $A_r/A_r(0)$ from Steps 3–6 with calibration plot or tabulated data to determine leveler concentration in the plating bath sample.

Preferred dilution titration procedure for suppressor analysis and calibration:

1. Electrode conditioning in supporting electrolyte (no additives)
2. Optional standard additions of anti-suppressor and/or leveler at concentrations estimated to correspond to those for the plating bath sample
3. Solution mixing
4. Measure $A_r(0)$
5. Standard addition of suppressor additive solution
6. Solution mixing
7. Measure $A_r$
9. Repeat Steps 5–7 until specific $A_r/A_r(0)$ ratio is attained (end point)
10. Repeat steps 1 and 4
11. Standard addition of plating bath sample
12. Solution mixing
13. Measure $A_r$
14. Repeat Steps 11–13 until the specific $A_r/A_r(0)$ ratio of Step 9 is attained (end point)
15. Calculate suppressor concentration in the plating bath sample taking into account appropriate dilution factors at the two end points.

Preferred modified linear approximation technique (MLAT) anti-suppressor analysis and calibration procedure:

1. Electrode conditioning in supporting electrolyte (no additives)
2. Addition of suppressor at concentration providing substantially full suppression
3. Optional standard addition of leveler at concentration estimated to correspond to that for the plating bath sample
4. Solution mixing
5. Measure $A_r(0)$
6. Standard addition of plating bath sample
7. Solution mixing
8. Measure $A_r(1)$
9. Standard addition of anti-suppressor solution
10. Solution mixing
11. Measure $A_r(2)$
12. Optional repeat of Steps 9–11 to obtain $A_r(3)$
13. Calculate anti-suppressor concentration in the plating bath sample assuming a linear $A_r/A_r(0)$ response and taking into account appropriate dilution factors.

The preferred embodiments of the present invention have been illustrated and described above. Modifications and additional embodiments, however, will undoubtedly be apparent to those skilled in the art. Furthermore, equivalent elements may be substituted for those illustrated and described herein, parts or connections might be reversed or otherwise interchanged, and certain features of the invention may be utilized independently of other features. Consequently, the exemplary embodiments should be considered illustrative, rather than inclusive, while the appended claims are more indicative of the full scope of the invention.

We claim:

1. A method for determining the concentration of a first additive that tends to decrease the copper electrodeposition rate in an acid copper electroplating bath also containing a second additive that tends to decrease the copper electrodeposition rate and a third additive that tends to increase the copper electrodeposition rate, comprising the steps of:

(1) measuring the copper electrodeposition rate in background electrolytes for a plurality of known concentrations of each of the first, second and third additives;

(2) identifying from the results of Step (1) an optimum background electrolyte having optimum concentrations of the second and third additives providing minimal interference, high sensitivity and good reproducibility for determining the concentration of the first additive from the effect of the first additive on the copper electrodeposition rate;

(3) determining the concentration in the electroplating bath of the second additive;

(4) determining the concentration in the electroplating bath of the third additive;

(5) providing a measurement solution comprised of a supporting electrolyte, a sample of the plating bath being analyzed, and the second and third additives at the respective concentrations determined in Step (2) to be optimum concentrations for determining the concentration of the first additive;

(6) measuring the copper electrodeposition rate in the measurement solution; and (7) comparing the copper electrodeposition rate measured in Step (6) with at least one copper electrodeposition rate measured in Step (1) to determine the concentration of the first additive in the sample of the plating bath.

2. The method of claim 1, wherein the first additive is a leveler, the second additive is a suppressor, and the third additive is an anti-suppressor with respect to copper electrodeposition.

3. The method of claim 1, wherein the copper deposition rates compared in Step (7) are normalized copper deposition rates obtained by dividing the copper deposition rates measured in Steps (1) and (6) by the copper deposition rate measured for the optimum background electrolyte.

4. The method of claim 1, further comprising the step of measuring the copper electrodeposition rate in the supporting electrolyte, wherein the copper deposition rates compared in Step (7) are normalized copper deposition rates obtained by dividing the copper deposition rates measured in Steps (1) and (6) by the copper deposition rate measured for the supporting electrolyte.

5. The method of claim 1, wherein the copper electrodeposition rate is measured via a cyclic voltammetric stripping (CVS) rate parameter.

6. The method claim 5, wherein the CVS rate parameter is selected from the group consisting of copper stripping peak area, copper stripping peak height, current at a cathodic potential, integrated current over a cathodic potential range, and average current over a cathodic potential range.

7. The method of claim 5, wherein the voltammetric rate parameter for the measurement solution is multiplied by a factor to correct for the difference in the concentrations of copper ions in the plating bath sample and the background electrolyte.

8. The method of claim 7, wherein the multiplication factor is the fraction, raised to the $n^{th}$ power, defined by the copper ion concentration of the supporting electrolyte divided by the copper ion concentration of the measurement solution after addition of the plating bath sample, where n is greater than 0 but not more than 1.

9. The method of claim 1, wherein the copper electrodeposition rate is measured via an alternating current (ac) electrode impedance measurement.

10. The method of claim 1, wherein the concentration of the second additive is determined in Step (3) by a calculation based on factors selected from the group consisting of additive makeup concentration, additive replenishment rate, prior bath additive analysis, and additive consumption rate.

11. The method of claim 1, wherein the concentration of the second additive is determined in Step (3) by the CVS response curve analysis.

12. The method of claim 1, wherein the concentration of the second additive is determined in Step (3) by the CVS dilution titration analysis.

13. The method of claim 1, wherein the concentration of the second additive is determined in Step (3) by a method selected from the group consisting of spectrophotometry, electrochemical ac impedance measurements, electrochemical impedance spectroscopy, and high performance liquid chromatography (HPLC).

14. The method of claim 1, wherein the concentration of the third additive is determined in Step (4) by a calculation based on factors selected from the group consisting of additive makeup concentration, additive replenishment rate, prior bath additive analysis, and additive consumption rate.

15. The method of claim 1, wherein the concentration of the third additive is determined in Step (4) by the CVS linear approximation technique (LAT) method.

16. The method of claim 1, wherein the concentration of the third additive is determined in Step (4) by the CVS modified linear approximation technique (MLAT) method.

17. The method of claim 1, wherein the concentration of the third additive is determined in Step (4) by a method selected from the group consisting of spectrophotometry, electrochemical ac impedance measurements, electrochemical impedance spectroscopy, and high performance liquid chromatography (HPLC).

18. The method of claim 1, wherein the acid copper plating bath comprises anions selected from the group consisting of sulfate, fluoroborate, sulfamate and alkylsulfonate.

19. A method for determining the concentration of a first additive that tends to decrease the copper electrodeposition rate in an acid copper electroplating bath also containing a second additive that tends to decrease the copper electrodeposition rate and a third additive that tends to increase the copper electrodeposition rate, comprising the steps of:

(1) measuring a CVS rate parameter in background electrolytes for a plurality of known concentrations of each of the first, second and third additives;

(2) identifying from the results of Step (1) an optimum background electrolyte having optimum concentrations of the second and third additives providing minimal interference, high sensitivity and good reproducibility for determining the concentration of the first additive from the effect of the first additive on the CVS rate parameter;

(3) determining the concentration in the electroplating bath of the second additive;

(4) determining the concentration in the electroplating bath of the third additive;

(5) providing a measurement solution comprised of a supporting electrolyte, a sample of the plating bath being analyzed, and the second and third additives at the respective concentrations determined in Step (2) to be optimum concentrations for determining the concentration of the first additive;

(6) measuring the CVS rate parameter in the measurement solution; and (7) comparing the CVS rate parameter measured in Step (6) with at least one CVS rate parameter measured in Step (1) to determine the concentration of the first additive in the sample of the plating bath.

20. The method of claim 19, wherein the CVS rate parameter is selected from the group consisting of copper stripping peak area, copper stripping peak height, current at a cathodic potential, integrated current over a cathodic potential range, and average current over a cathodic potential range.

21. The method of claim 19, wherein the CVS rate parameters compared in Step (7) are normalized CVS rate parameters obtained by dividing the CVS rate parameters measured in Steps (1) and (6) by the CVS rate parameter measured for the optimum background electrolyte.

22. The method of claim 19, further comprising the step of measuring the CVS rate parameter in the supporting electrolyte, wherein the CVS rate parameters compared in Step (7) are normalized CVS rate parameters obtained by dividing the CVS rate parameters measured in Steps (1) and (6) by CVS rate parameter measured for the supporting electrolyte.

23. A method for determining the concentration of a first additive that tends to decrease the copper electrodeposition rate in an acid copper electroplating bath also containing a second additive that tends to decrease the copper electrodeposition rate and a third additive that tends to increase the copper electrodeposition rate, comprising the steps of:

(1) measuring a CVS stripping peak area parameter with electrode rotation ($A_r$) in background electrolytes for a plurality of known concentrations of each of the first, second and third additives;

(2) identifying from the results of Step (1) an optimum background electrolyte having optimum concentrations of the second and third additives providing minimal interference, high sensitivity and good reproducibility for determining the concentration of the first additive from the effect of the first additive on the $A_r$ parameter;

(3) determining the concentration in the electroplating bath of the second additive by the CVS response curve analysis or the CVS dilution titration analysis;

(4) determining the concentration in the electroplating bath of the third additive by the CVS linear approximation technique (LAT) method or the modified linear approximation (MLAT) technique method;

(5) providing a measurement solution comprised of a supporting electrolyte, a sample of the plating bath being analyzed, and the second and third additives at the respective concentrations determined in Step (2) to be optimum concentrations for determining the concentration of the first additive;

(6) measuring the $A_r$ parameter in the measurement solution; and (7) comparing the $A_r$ parameter measured in Step (6) with at least one $A_r$ parameter measured in Step (1) to determine the concentration of the first additive in the sample of the plating bath.

24. The method of claim 23, wherein the $A_r$ parameters compared in Step (7) are normalized $A_r/A_r(0)$ parameters obtained by dividing the $A_r$ parameters measured in Steps (1) and (6) by the $A_r(0)$ rate parameter measured for the optimum background electrolyte.

25. The method of claim 23, further comprising the step of measuring the $A_r$ parameter in the supporting electrolyte, wherein the $A_r$ parameters compared in Step (7) are normalized $A_r/A_r(0)$ parameters obtained by dividing the $A_r$ parameters measured in Steps (1) and (6) by the $A_r(0)$ rate parameter measured for the supporting electrolyte.

26. A method for determining the concentration of a first additive that tends to decrease the metal electrodeposition rate in an electroplating bath also containing a second additive that tends to decrease the metal electrodeposition rate and a third additive that tends to increase the metal electrodeposition rate, comprising the steps of:

(1) measuring the metal electrodeposition rate in background electrolytes for a plurality of known concentrations of each of the first, second and third additives;

(2) identifying from the results of Step (1) an optimum background electrolyte having optimum concentrations of the second and third additives providing minimal interference, high sensitivity and good reproducibility for determining the concentration of the first additive from the effect of the first additive on the metal electrodeposition rate;

(3) determining the concentration in the electroplating bath of the second additive;

(4) determining the concentration in the electroplating bath of the third additive;

(5) providing a measurement solution comprised of a supporting electrolyte, a sample of the plating bath being analyzed, and the second and third additives at the respective concentrations determined in Step (2) to be optimum concentrations for determining the concentration of the first additive;

(6) measuring the metal electrodeposition rate in the measurement solution; and (7) comparing the metal electrodeposition rate measured in Step (6) with at least one metal electrodeposition rate measured in Step (1) to determine the concentration of the first additive in the sample of the plating bath.

27. The method of claim 26, wherein the metal is selected from the group consisting of copper, tin, tin-lead, zinc and nickel.

* * * * *